US006933481B2

(12) United States Patent
Greenburg

(10) Patent No.: US 6,933,481 B2
(45) Date of Patent: Aug. 23, 2005

(54) CUSTOMER-ENGAGING FOOD MERCHANDISING MODULE

(76) Inventor: Mark Greenburg, 6336 N. 48th Pl., Paradise Valley, AZ (US) 85253

( * ) Notice: Subject to any disclaimer, the term of this patent is extended or adjusted under 35 U.S.C. 154(b) by 0 days.

(21) Appl. No.: 10/839,681

(22) Filed: May 4, 2004

(65) Prior Publication Data

US 2004/0206752 A1 Oct. 21, 2004

Related U.S. Application Data

(63) Continuation-in-part of application No. 10/256,801, filed on Sep. 27, 2002, now Pat. No. 6,777,654.

(51) Int. Cl.[7] ..... H05B 6/64

(52) U.S. Cl. ..... 219/679; 219/678; 221/150 HC

(58) Field of Search ..... 219/400, 521, 219/679–681, 725–734; 426/107, 113, 234, 243; 221/123, 125, 210, 277, 150 R, 150 A, 150 HC; D6/466, 474, 475

(56) References Cited

U.S. PATENT DOCUMENTS

| | | | | | |
|---|---|---|---|---|---|
| 381,605 | A | * | 4/1888 | Smith | 227/141 |
| D85,013 | S | | 9/1931 | Teller et al. | |
| D191,024 | S | | 8/1961 | Buday | |
| D202,532 | S | | 10/1965 | Smith | |
| 3,397,817 | A | | 8/1968 | Smith | |
| 3,534,676 | A | * | 10/1970 | Rubino | 219/679 |
| 3,887,786 | A | | 6/1975 | Witt et al. | |
| 4,004,712 | A | * | 1/1977 | Pond | 221/150 A |
| T973,013 | I4 | | 8/1978 | Ferrara et al. | |
| D256,644 | S | | 9/1980 | Marks | |
| 4,531,387 | A | | 7/1985 | Cotton | |
| 4,592,485 | A | * | 6/1986 | Anderson et al. | 221/150 HC |
| D284,917 | S | | 8/1986 | Canter | |
| D289,838 | S | | 5/1987 | Taub | |
| 4,783,582 | A | * | 11/1988 | Wada et al. | 219/679 |
| 4,880,954 | A | * | 11/1989 | Bennett et al. | 219/679 |
| 4,989,426 | A | | 2/1991 | Kretchman et al. | |
| D364,513 | S | | 11/1995 | Andrews | |
| D364,762 | S | | 12/1995 | Compton et al. | |
| 5,573,082 | A | * | 11/1996 | Conlan et al. | 186/44 |
| D438,403 | S | | 3/2001 | Greenburg | |

* cited by examiner

*Primary Examiner*—Tu Hoang
(74) *Attorney, Agent, or Firm*—Booth Udall, PLC

(57) ABSTRACT

An apparatus and method are disclosed for penetrating convenience store food markets with a customer-engaging food merchandising module. The customer-engaging food merchandising module comprises three units: a food storage and display unit attached to a food preparation and display unit, and a shell unit attached to at least one of the other two units. One embodiment of the apparatus comprises: a glass-door freezer for storing and displaying at least one type of frozen food, a microwave oven attached to the freezer, and a shell attached to the freezer. The shell is used to support advertising and instructional graphics and also to give the apparatus a unitary appearance. The microwave oven has pre-programmed buttons corresponding to each of the types of food displayed in the freezer, each button activating the microwave oven to correctly heat a corresponding type of frozen food. The shell may extend above the freezer/microwave combination. The apparatus may be completely assembled in a factory and shipped ready-to-use. Maintenance may be by replacement of defective or outdated units. The entire apparatus plugs into one ordinary wall outlet for electrical power.

34 Claims, 12 Drawing Sheets

CUSTOMER-ENGAGING FOOD MERCHANDISING MODULE

This application is a continuation-in-part of U.S. patent application Ser. No. 10/256,801, by Mark Greenburg, filed Sep. 27, 2002 now U.S. Pat. No. 6,777,654, entitled CUSTOMER-ENGAGING MERCHANDISING MODULE.

BACKGROUND OF THE INVENTION

1. Technical Field

This invention generally relates to a retail food merchandising apparatus and method. This invention more specifically relates to self-service frozen food merchandising.

2. Background Art

Following the rise to prominence of "convenience stores" as suburban marketplaces, attempts have been made to improve the merchandising of frozen food to convenience store customers. The original baseline method is simply to display frozen food in a freezer case for the consumer to purchase, take home, and prepare. An improvement in this method was to provide a microwave oven on the convenience store premises to allow heating of the various frozen foods offered. The amount of time and the proper power setting for each of the many frozen foods offered, despite conventionally being printed on the food packaging, is sometimes difficult to determine for a particular microwave oven, requiring some disappointing experiments by the consumer.

A separate problem in convenience store merchandising is the problem of penetration for non-franchise producers. Most convenience stores are franchises, so the floor layout of the merchandising displays and the contents of those displays is largely predetermined. In order to have a new product marketed in the convenience store, it may have to displace a product in a carefully calculated merchandising scheme. This may be a very difficult obstacle for an outside producer to overcome. Even when that obstacle is overcome, additional problems face an outside producer of a new product before it may be profitably added to the convenience store's merchandising scheme. Adding a product may require modifying the store floor plan or utility outlets. This is a substantial obstacle to acceptance of a new product by the store management. An example of this problem is an earlier attempt by the inventor to market frozen food through convenience stores. U.S. Pat. No. D438,403 S to Greenburg (Mar. 6, 2001) shows the outward configuration of a merchandise display case for frozen food. Some devices of this design, in operation, required three separate electrical outlets and would not run on standard 12 amp/120 volt lines. Necessary modifications to accommodating utility outlets in convenience stores were an obstacle to market penetration and profitability.

It would be advantageous to the art to have an apparatus and method for easily penetrating convenience store markets with frozen food displays. The method and apparatus should minimize the costs and disruptions of previous systems while maximizing the convenience of purchasing to the consumer.

SUMMARY OF THE INVENTION

Accordingly, an apparatus and method are disclosed for penetrating convenience store frozen food markets with a customer-engaging frozen food display. The customer-engaging food merchandising module comprises three units:

a food storage and display unit releasably attached to a food preparation and display unit, and a shell unit releasably attached to at least one of the other two units. One embodiment of the apparatus comprises: a glass-door freezer for storing and displaying at least one frozen food, a microwave oven attached to the freezer, and a shell attached to the freezer. Embodiments of the shell are configured to have widths co-extensive with the width of the base and advertising and instructional graphics placed thereon to give the modular apparatus a unitary appearance. The microwave oven has one or more pre-programmed buttons corresponding to each of the foods displayed in the freezer, each button activating the microwave oven to correctly heat a corresponding frozen food. The shell may extend above the freezer/microwave combination. The apparatus may be completely assembled in a factory and shipped ready-to-use. Maintenance may be by replacement of defective units, rather than the entire apparatus. The entire apparatus plugs into one ordinary wall outlet for electrical power. The invention also extends to non-frozen foods and preparation methods other than just heating.

The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

As discussed above, embodiments of the present invention relate to a customer-engaging food merchandising module.

Figure 1:
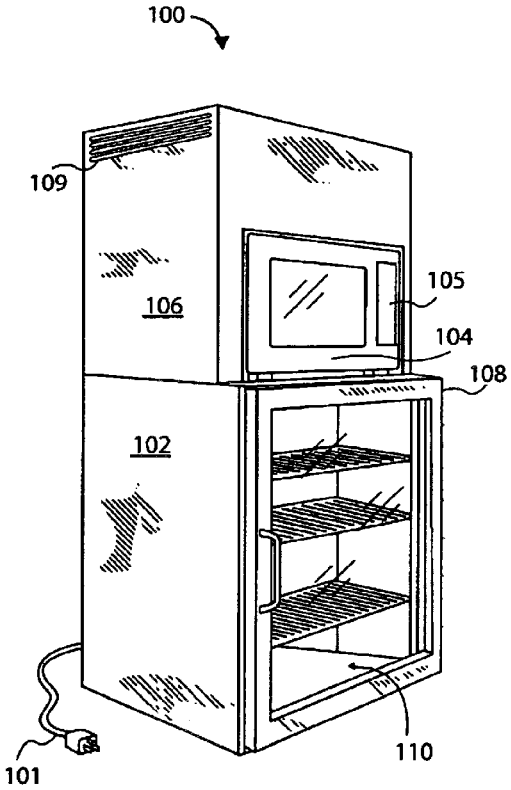
FIG. 1 illustrates a first embodiment of a customer-engaging food merchandising module.

FIG. 1 illustrates an embodiment of a customer-engaging food merchandising module 100 comprising a food storage unit 102 for storing food, having a customer-operable door 108 with at least one window 110 for displaying the stored food, a food preparation unit 104 for changing the stored food from a stored condition to a ready-to-eat condition, and a removable shell 106 adapted to display advertising. For example, the food storage and display unit 102 may be a freezer 102 with a glass 110 door 108, the food preparation unit 104 may be a microwave oven 104, and the shell 106 may be constructed of foam board of the type used for poster-backing. The shell may be sized and shaped to give the customer-engaging food merchandising module 100 a frontal appearance of substantially uniform width (see FIG. 2) and particular embodiments of the invention may further include a substantially uniform depth (see FIG. 3). The food preparation unit 104 is customer-operable and may have a control panel 105. The food preparation unit 104 may also display the food in preparation, i.e., through a window.

In a particular embodiment, the food storage and display device 102 may be a refrigerator. In another particular embodiment, the food storage and display device 102 may be a vegetable bin, such as a potato bin. In yet another particular embodiment, the food preparation unit 104 may be a toaster oven. In still yet another particular embodiment, the food preparation unit 104 may be a steamer. Most embodiments will be vertically stacked, as shown, but some embodiments may be horizontally or otherwise arranged (see FIG. 8). For example, a food storage and display unit 104 may be placed on a shelf beside a food preparation unit 104 having a shell 106 over it. Embodiments of the apparatus are configured compactly to make thrifty use of available retail space, whether on a floor, counter top, or shelf. Particular embodiments may include more than one food preparation unit 104. All the food preparation units 104 may be of the same type to serve customers faster, or may be of different types for different preparations. For example, thin crust pizza may be prepared in a toaster oven 700 (FIG. 7), while thick crust (i.e., french bread) pizza is prepared in a microwave oven 104, both foods being stored in the same food storage unit 102. In another particular embodiment, a plurality of food preparation units 104 are aligned beside the food storage unit 102 and attached to the food storage unit 102 and to each other (see FIG. 8). The customer-engaging food merchandising module 100 is preferably manufactured to operate using one standard electrical wall outlet, such as a twelve ampere, 120-volt outlet, and has a power cord 101 for that purpose. Different countries may have different power standards to which the present invention may be readily adapted by one of ordinary skill in the art.

The shell may be open at the top to vent any heat or exhaust from the food preparation unit 104. In some embodiments, the shell 106 may be shaped to direct the appetizing aroma of the food being prepared towards the customer using the customer-engaging food merchandising module 100. In a variation of these embodiments, the shell 106 is shaped to direct the appetizing aroma to potential customers not yet attracted to the customer-engaging food merchandising module 100. The shaping of the shell may comprise vents 109. The shell 106 may be configured to adjustably direct such aromas, so that the direction of potential customers may be determined and exploited uniquely in each marketplace.

The customer-engaging food merchandising module 100 may be sized to sit on a counter top 710 (FIG. 7) or other surface, usually at a height at least 24 inches above the floor. It is preferred that embodiments with microwave ovens 104 be elevated to a point that keeps the control panel 105 out of reach of small children. The surface may be fixed or mobile. In an exemplary alternate embodiment, the customer-engaging food merchandising module 100 may be adapted to a cart for portable or stationary food sales at fairs, ball games, and the like. The cart may have an electrical generator, photo voltaic array, or may use locally available electrical power.

Figure 2:
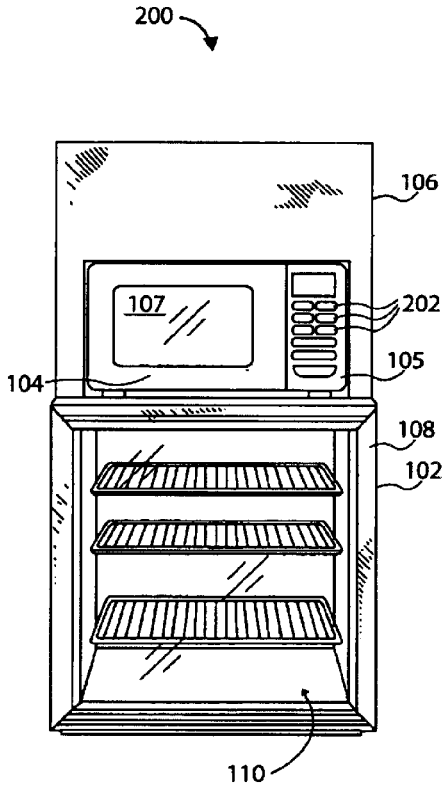
FIG. 2 illustrates a second embodiment of a customer-engaging food merchandising module.

FIG. 2 illustrates another embodiment of a customer-engaging food merchandising module 200 which includes a plurality of buttons 202 on control panel 105. The food preparation unit 104 may be adapted to prepare a variety of stored foods. Rather than require the customer to experiment with food preparation timing, pre-programmed preparation times are associated with individual control buttons 202, as are known in the art of microwave ovens 104, and the customer may select the button 202 appropriate to the food selected from storage for preparation. Distinct from conventional microwave ovens, which include generic pre-programmed preparation times associated with control buttons for general food categories, the pre-programmed preparation times associated with the individual control buttons 202 of the present invention are programmed to correspond specifically to the proper cook time of a specific food stored in the food storage unit 102 (see also FIG. 6 and related discussion). In this way, a particular food product stored in the food storage unit 102 at a particular known temperature may be placed in the food preparation unit 104 and heated to a correct temperature for consumption with the push of a single button. No experimentation or guessing is required by the customer, and there is a significantly greater likelihood that the food product will be cooked perfectly every time. The pre-programmed cook times may, for example, account for the ingredients of the specific corresponding food item, the size of the food item, the temperature at which the food item is stored, and the heating power of the food preparation unit. The pre-programmed control buttons may further include wait times or different power settings for portions of a heating cycle to optimally heat the corresponding food product. Such programming may also be extended to toaster ovens and steamers and similarly associate a pre-programmed control button with a corresponding food stored in the storage unit. The food preparation unit 104 may have a window 107 for viewing the food during preparation.

In an alternate embodiment, the control panel 105 may be a touch-sensitive computer screen, possibly integrated into the food preparation unit 140 and may display a menu of different types of food to be prepared. The consumer may select from the menu a preparation appropriate to the food selected. The invention contemplates any means by which the consumer may specify what food is to be prepared. For example, a bar code reader may be adapted to read a UPC code from a package in which a food item is stored and to transmit that code to an oven 104 controller responsive to the code to load the proper preparation program. In some embodiments which automatically recognize the food item to be heated or only include a single food product in the food storage unit 102, after the consumer puts the food item in the food preparation unit 104, the consumer need only push a "start" button to initiate the loaded preparation program. For another example, voice-responsive input devices may be used in place of or as an alternative in addition to buttons 202.

Figure 3:
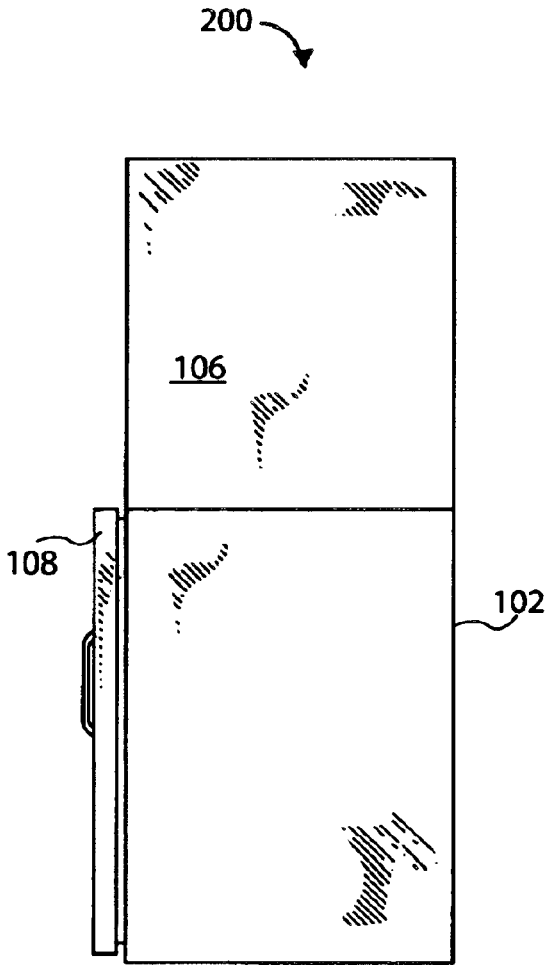
FIG. 3 is a side view of an embodiment of a customer-engaging food merchandising module.

FIG. 3 is a side view of an embodiment of a customer-engaging food merchandising module 200. The straight back of the display 200 economizes on counter space by not requiring a stand off from the wall even with the electrical plug in place. In a free-standing embodiment, the shell 106 may extend at least partially down the back of the food storage unit 102 to provide additional advertising support surface and hide electrical outlets or cords.

Figure 4:
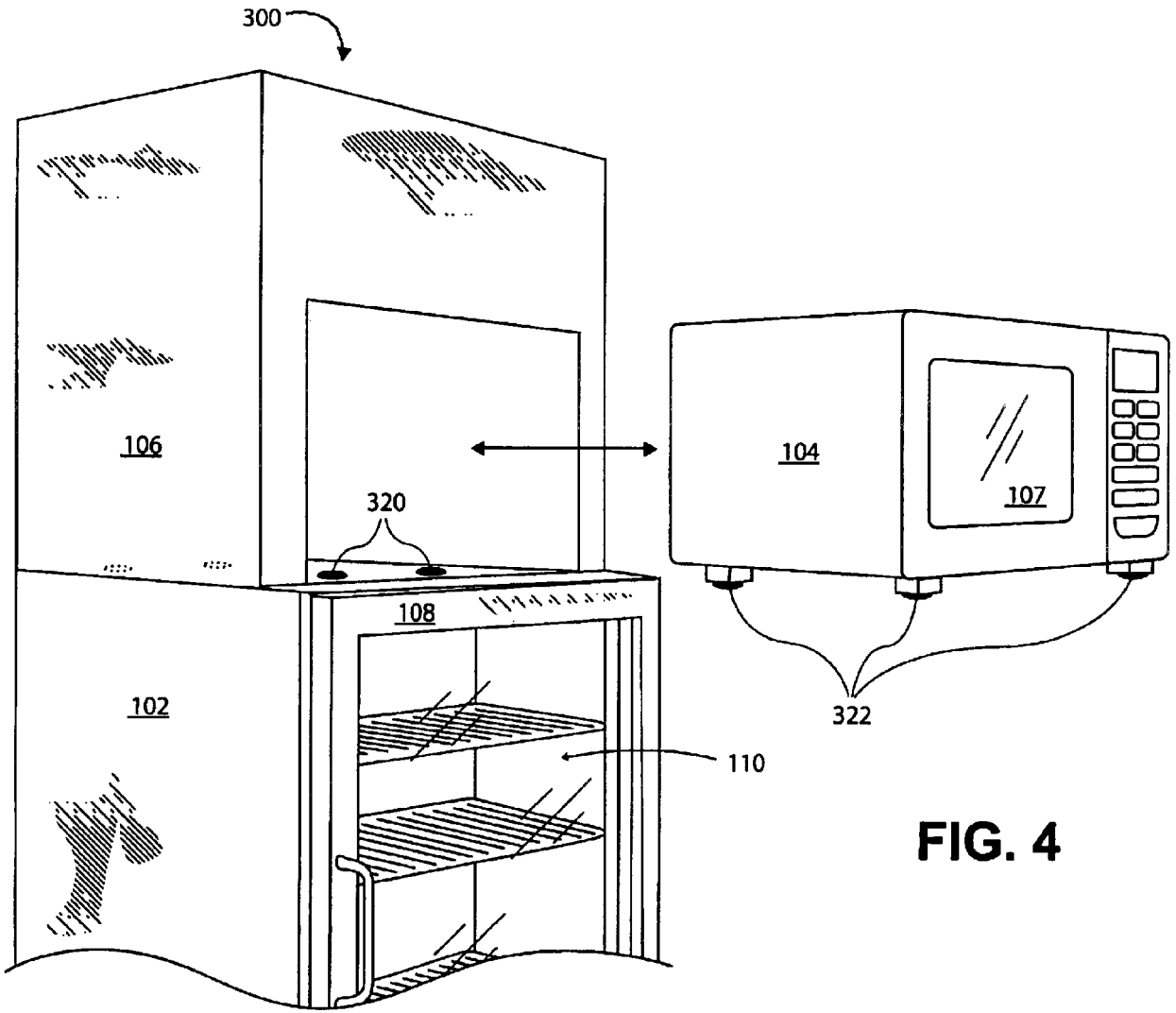
FIG. 4 illustrates an embodiment of a customer-engaging food merchandising module with foot connectors.

FIG. 4 illustrates an embodiment of a customer-engaging food merchandising module 300, with details of attachment mechanisms 320 and 322. In a simple embodiment, the attachment mechanisms are hook 320 and loop 322 fasteners, such as those sold under the trademark VELCRO. The loop portions 322 may be glued to the feet of the microwave oven, and the hook 320 portions glued to the top of the food storage unit 102 in a complimentary pattern. Hook 320 and loop 322 portions may, of course, be reversed as to their positions on a foot of the food preparation unit 104 or top of the food storage unit 102. Other types of fasteners are also contemplated by the invention. For example, latches, locks, bolts, and snap-lock fittings may be used. The requirement is to achieve an attachment sufficiently secure to enable shipping as an integrated, ready-to-use unit 300.

Figure 5:
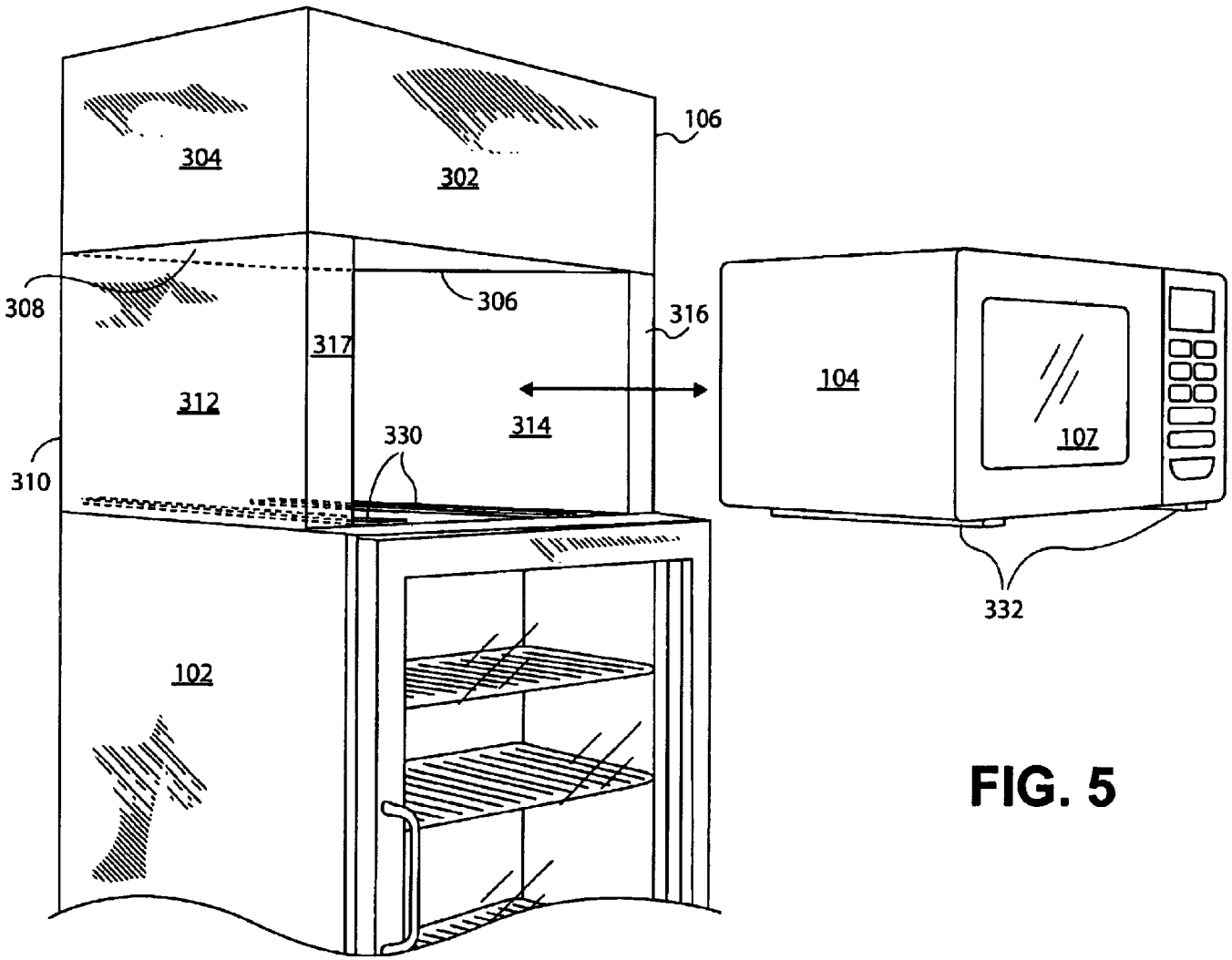
FIG. 5 illustrates an embodiment of a customer-engaging food merchandising module with rail connectors.

FIG. 5 includes an alternate embodiment of a customer-engaging food merchandising module 350, having channels 330 adapted to receive rails 332. Channels 330 may be attached to the top of the food storage unit 102, and rails 332 may be attached to the bottom of the food preparation unit 104. The rails 332 may have latches, locks, or similar connectors, to maintain a fixed connection during shipping and use. Also shown in FIG. 5 is an example of a shell comprised of a plurality of panels 302–317. Panels 302, 304, 308 and 306 form a rectangular top section of the shell 106. Back panel 312, side panels 312 and 314, and front side panels 316 and 317 form an open, semi-rectangular bottom section. Other divisions of panels 302–317 may be used. For example, panels 304 and 312 may be a single panel, panels 308 and 312 may be a single panel, etc. In an embodiment, the shell 106 may be comprised of a single patterned piece of foam board, card board, corrugated paper board, or similar material which has been scored and folded to form the corners of the shell 106. The shell 106 may include internal structures for bracing, attachment, and directing appetizing aromas from the exhaust of the food preparation unit 104 toward prospective customers. The exhaust-directing panels (FIG. 1) may be adjustable. All of the normally visible surfaces of the panels 302–317 may support advertising or informational signs. Such advertising or informational signs may extend graphically across a junction between any of the modular parts of the whole unit (e.g. across the junction between the shell and the freezer or across a gap between the shell and the microwave or the microwave and the freezer) so as to create a more unitary appearance for the entire unit.

Informational signs may instruct the consumer on the steps to take to prepare and purchase the stored food. Advertising signs attempt to attract the consumer to the customer-engaging food merchandising module and the items of food for sale. The advertising signs may exploit the unitary appearance of the modular customer-engaging food merchandiser 100. For example, a single graphic design may extend over the entire height of each side of the merchandiser 100, encompassing both the side wall of the food storage unit 102 and the shell 106. In addition to signs, other methods of attracting and informing the consumer may be used. In a particular embodiment, a recorded, synthesized, or stored voice message may be played in response to the consumer opening the door 108 of the food storage unit 102 or in response to similar excitation. For example, a motion detector may be configured to detect when someone is near the customer-engaging food merchandising module 350. When a person is detected, the voice message is activated.

Figure 6:
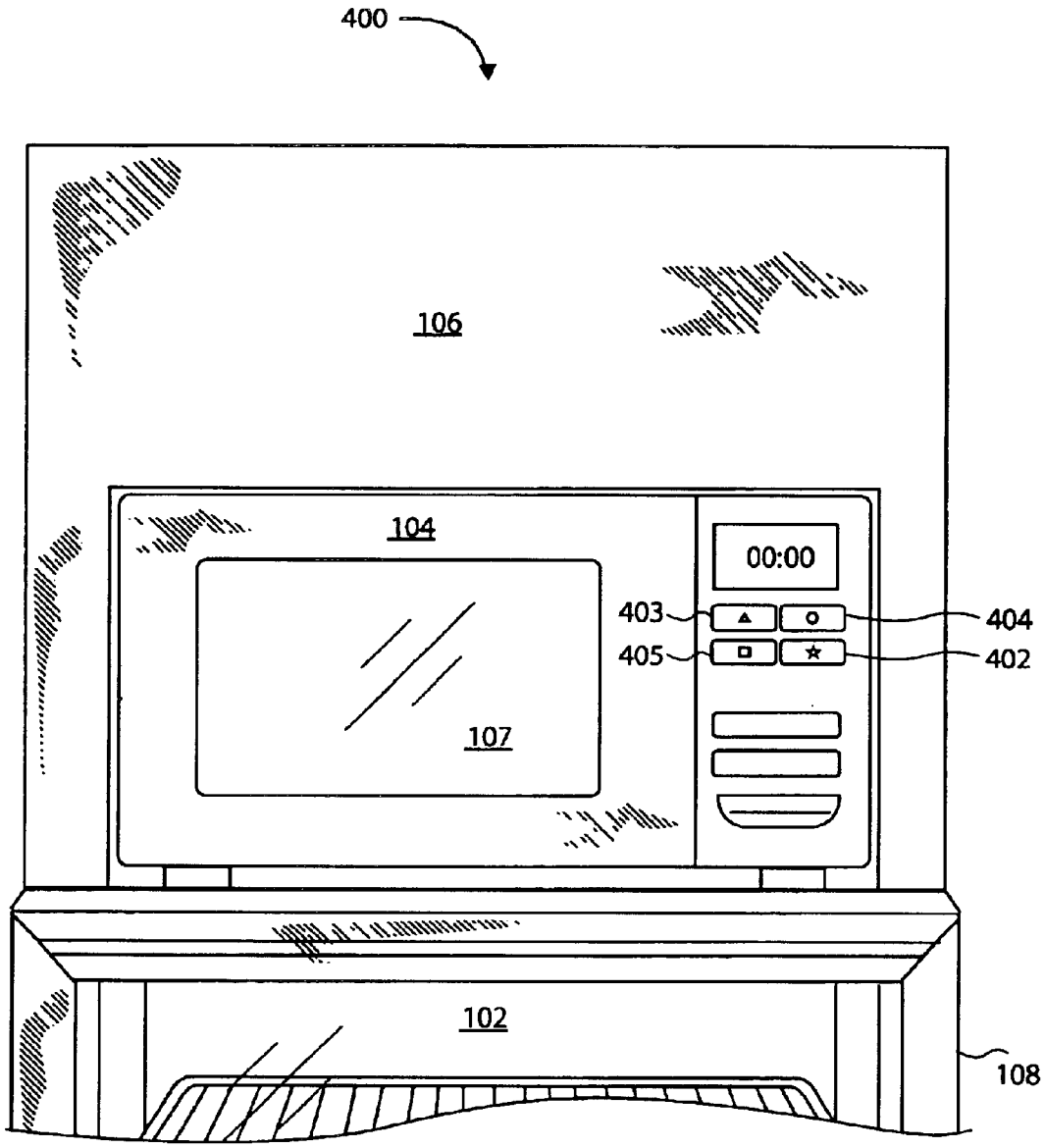
FIG. 6 illustrates an embodiment of a customer-engaging food merchandising module with details of heating unit controls.

FIG. 6 illustrates an embodiment of a customer-engaging food merchandising module 400 having buttons 402–405 corresponding to different types of frozen food, such as frozen french-bread pizza, at least two of which require different heating times. Each button 402–405 may have the symbol of a different type of pizza displayed on its surface. In other exemplary embodiments, the buttons may correspond by color, shape, pattern, number, name, or texture to different types of stored food. In a particular embodiment, at least one button 402–405 may be programmed for a heating time followed by a waiting time, the waiting time established to allow the food to cool to a safe temperature for eating. For example, micro-waved foods should generally not be eaten or handled immediately after being micro-waved. During the waiting time, the microwave oven 104 may not signal a state different from heating, as by a bell, fan cut-off, or light, so that the consumer may think that heating is still in progress and so not become impatient with waiting. Alternatively, the microwave oven 104 may indicate the end of the heating time but thereafter indicate a cooling time countdown which may continue to run a microwave fan to quickly cool the food.

Figure 7:
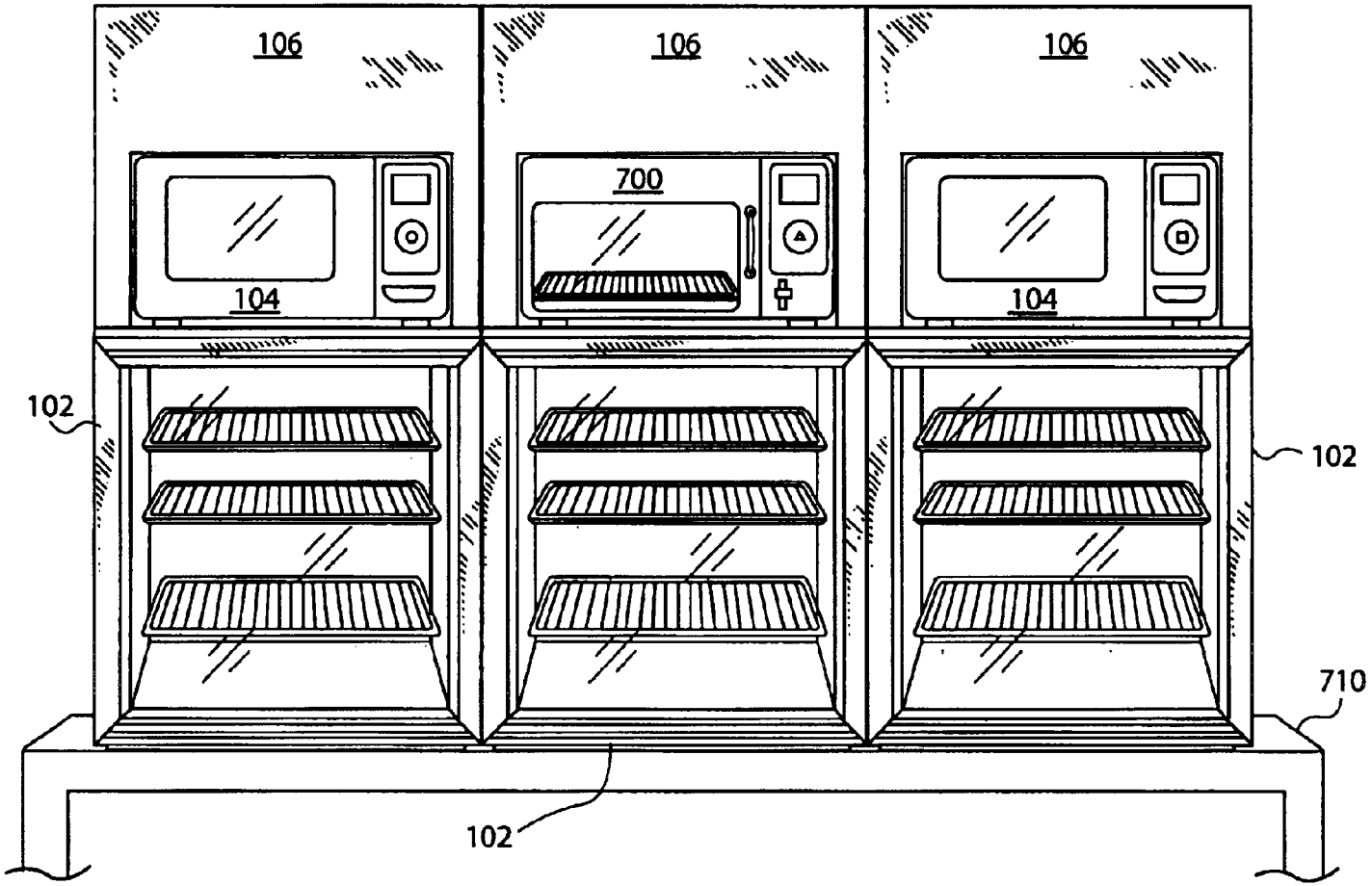
FIG. 7 illustrates exemplary embodiments of a plurality of customer-engaging food merchandising modules arranged side-by-side on a counter-top.

FIG. 7 illustrates three customer-engaging food merchandising modules together on a counter top 710. The middle merchandising module is shown with a toaster oven 700 as a food preparation module 104. The invention comprehends a variety of food preparation modules 104, 700. In an embodiment of the invention, each of the grouped modules provides one type of food, and has one button 720–722 on each unit which is programmed for a preparation time appropriate to that food. Alternatively, Any plurality of merchandising modules may be grouped together.

Figure 8:
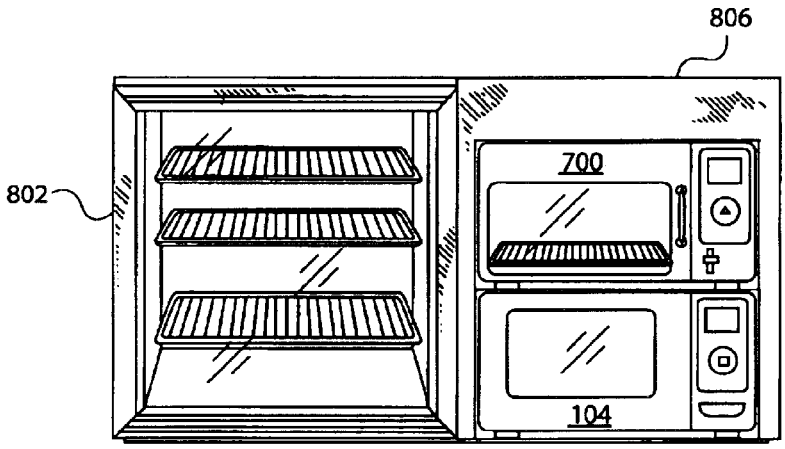
FIG. 8 illustrates an embodiment of a customer-engaging food merchandising module with a side-attached plurality of food preparation units and side-attached shell.

FIG. 8 illustrates a single food storage unit 102 with two food preparation units 104 and 700 attached to the side of the food storage unit 102 and a shell 106, attached to the side of the food storage unit 102 and the food preparation units 104 and 700, the shell providing a unitary appearance and allowing for shipment as a single, ready-to-use unit.

Figure 9:
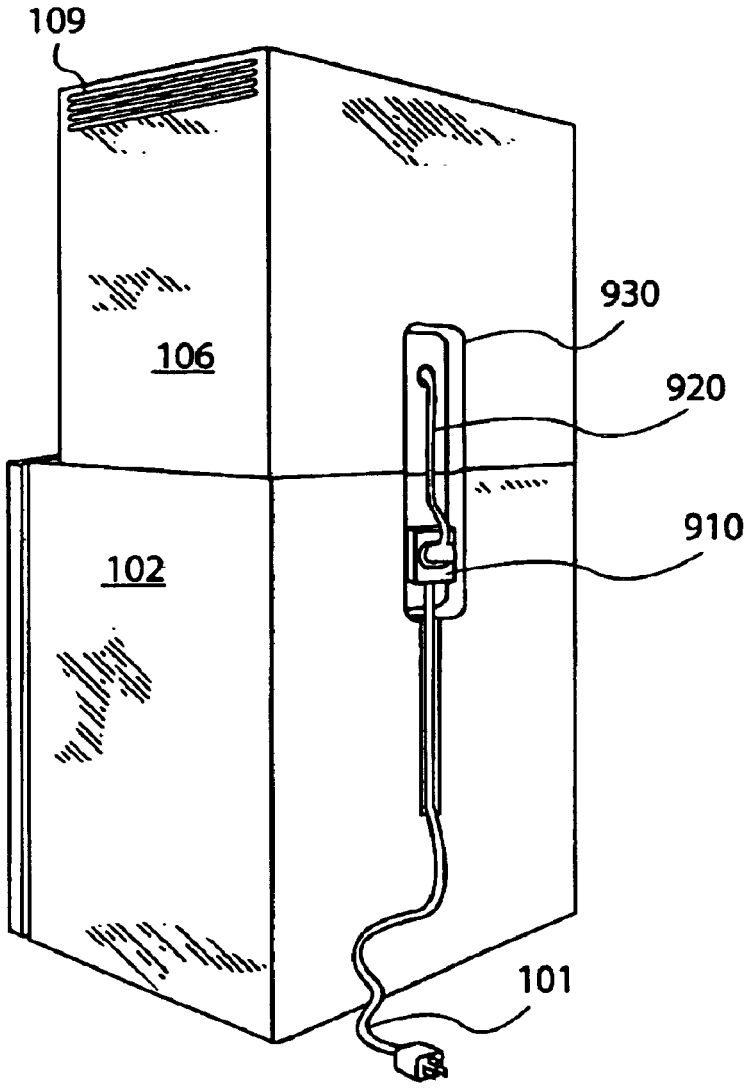
FIG. 9 is a rear perspective view of an embodiment of a customer-engaging food merchandising module having a recessed area for the power distribution unit and related power cords.

FIG. 9 illustrates the back of a customer-engaging food merchandising module with a recess 930 containing a power distribution unit 910. A power cord 920 from the food preparation unit 104 (FIG. 1), attached at the top and covered by shell 106, plugs into a power distribution unit 910 mounted to the food storage unit 102 which may be direct wired to the power distribution unit 910 or plugged into it through a separate food storage unit power cord. Power cord 101 extends from power distribution unit 910 and can be plugged into a standard wall outlet. For example, a wall outlet providing single-phase 12-Amp/120 Volt alternating current is an American standard electrical outlet. Other countries may have other standards, to which the invention may be adapted. The power requirements of the food storage unit 102 and the food preparation unit 104 (FIG. 1) are selected to enable the entire customer-engaging food merchandising module to run using the power supplied through one power cord with one plug. Power distribution unit 910 may supply the food storage unit 102 with power through a connection behind the power distribution unit 910 or unit 910 may, in a particular embodiment, have a socket for receiving a power cord plug from the food storage unit 102. For customer-engaging food merchandising modules having multiple food preparation units 104 and/or 700, additional power distribution circuitry is required to connect the additional food preparation units 104 and/or 700, and may include circuitry to allow only one food preparation unit 104 and/or 700 to operate at a time.

Figure 10:
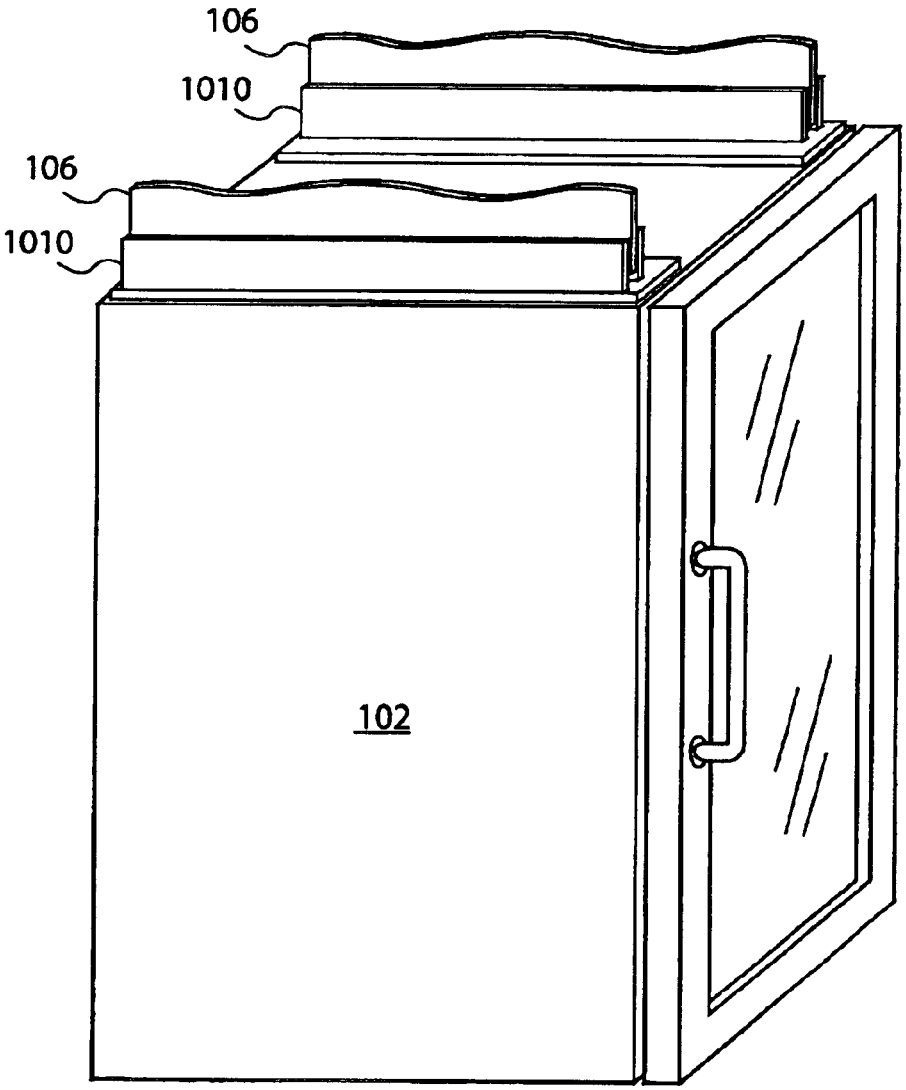
FIG. 10 is perspective view of a food storage unit of an embodiment of the customer-engaging food merchandising module with brackets attached to the top of the food storage unit receiving edges of a shell.

FIG. 10 illustrates an example of brackets 1010 attached to the top of the food storage unit 102 and receiving edge portions of shell 106. The edge portions of shell 106 engaged by brackets 1010 may be the edges of interior panels of shell 106 and may be clear so as to not hide any portion of graphics on the shell. Engaging interior panels maximizes the unitary appearance of the apparatus. In an alternate embodiment, the brackets 1010 may engage the exterior panels of shell 106. Brackets 1010 may, alternatively or additionally be secured to the food preparation unit 104 (FIG. 1). Brackets 1010 may be made of resilient material, with a vertical gap slightly less wide than the shell 106 panel thickness. When the shell 106 is inserted into the bracket 1010, the bracket 1010 resiliently holds the shell 106 in place. Bracket 1010 was chosen for ease of use in manufacturing customer-engaging food merchandising modules. However, a wide variety of bracket designs and other methods of attachment, as would be obvious to those of skill in art, are contemplated by the invention.

Figure 11:
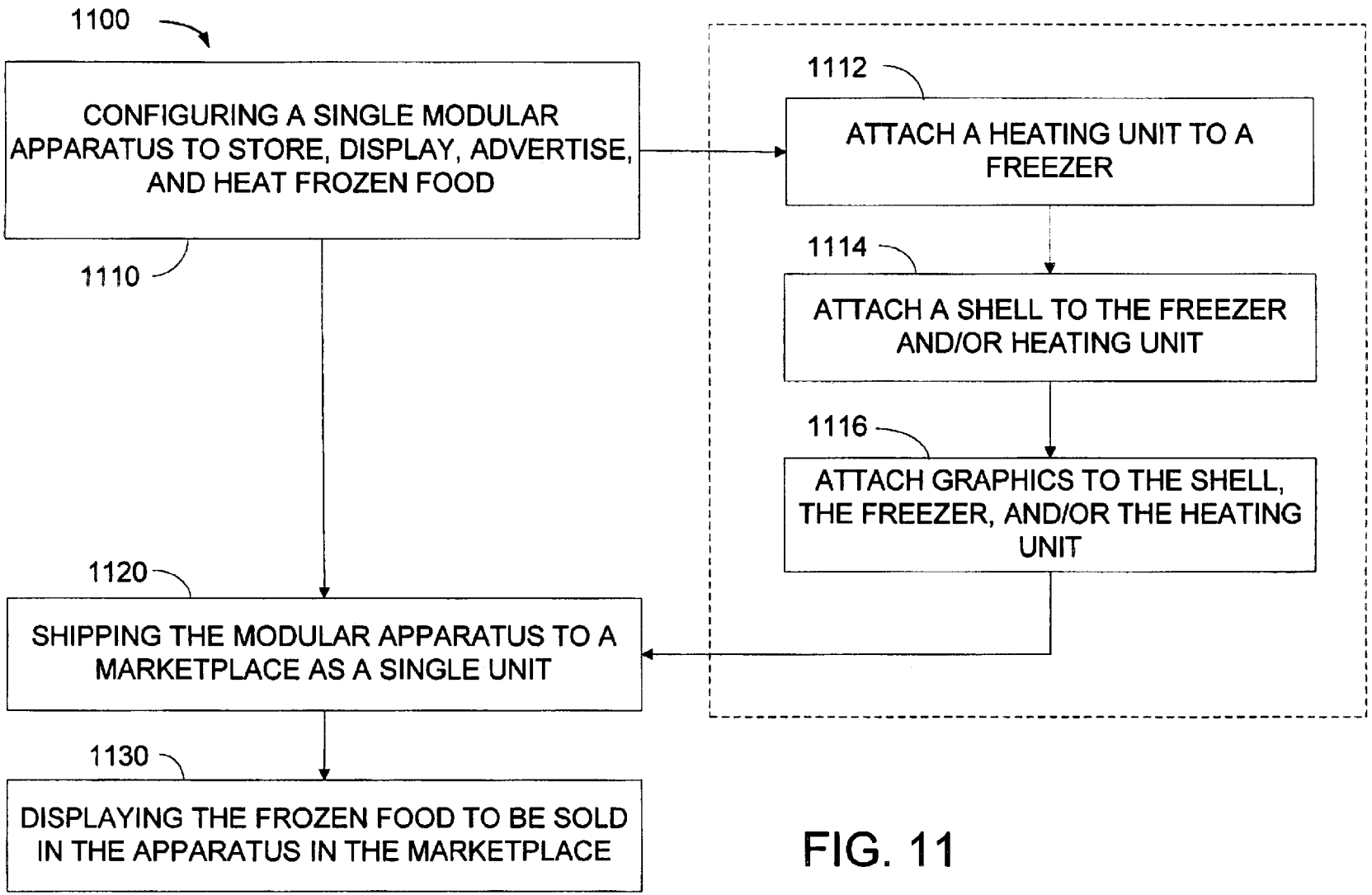
FIG. 11 is a flow diagram of a method of marketing frozen food using embodiments of the customer-engaging food merchandising module of the present invention.

FIG. 11 (See also FIG. 1) includes a diagram for a method 1100 of merchandising frozen food. In the first step 1110, a modular apparatus that meets the description of a consumer-engaging food merchandising module may be configured. Step 1110 may comprise steps 1112–1116, for an embodiment using a freezer 102 and a microwave oven 104. Step 1114 includes configuring the shell 106 to be attached or configuring the shell as it is attached. The shell width may be configured to be coextensive with the width of the freezer to help in giving the modular unit a unitary appearance. Step 1116 includes printing graphics directly on the shell 106, freezer and/or microwave oven, or otherwise attaching graphics to the shell, freezer and/or microwave oven. The graphics may be configured such that a graphics pattern extends from the shell to the freezer and/or microwave to further give the modular unit a unitary appearance. Additional display features may also be included to further encourage customers to purchase the food. Display features may include windows in the freezer 102 and microwave oven 104, lighting in the freezer 102 and oven 104, and shelving in the freezer 102 adapted to best display the particular frozen food.

In step 1120, the consumer-engaging food merchandising module is shipped as an entire unit that is ready to plug in and use. This aspect of the invention is particularly beneficial from a profitability view. Prior to the present invention, frozen food merchandizers either did not include a heating unit, included a heating unit which was not attached to the freezer and needed to be displayed separate from the freezer, or some other display assembly was required on site. The assembly required the merchandizer to send out an installer to assemble a display. If additional electrical requirements needed to be met, which would generally be required if a freezer and a microwave are used together, the merchandizer would need to hire an electrician to assist in the installation. With the present invention, the freezer, heating unit and shell are all preassembled as a single unit and work with a standard outlet. No installation or electrical work is required.

Figure 12:
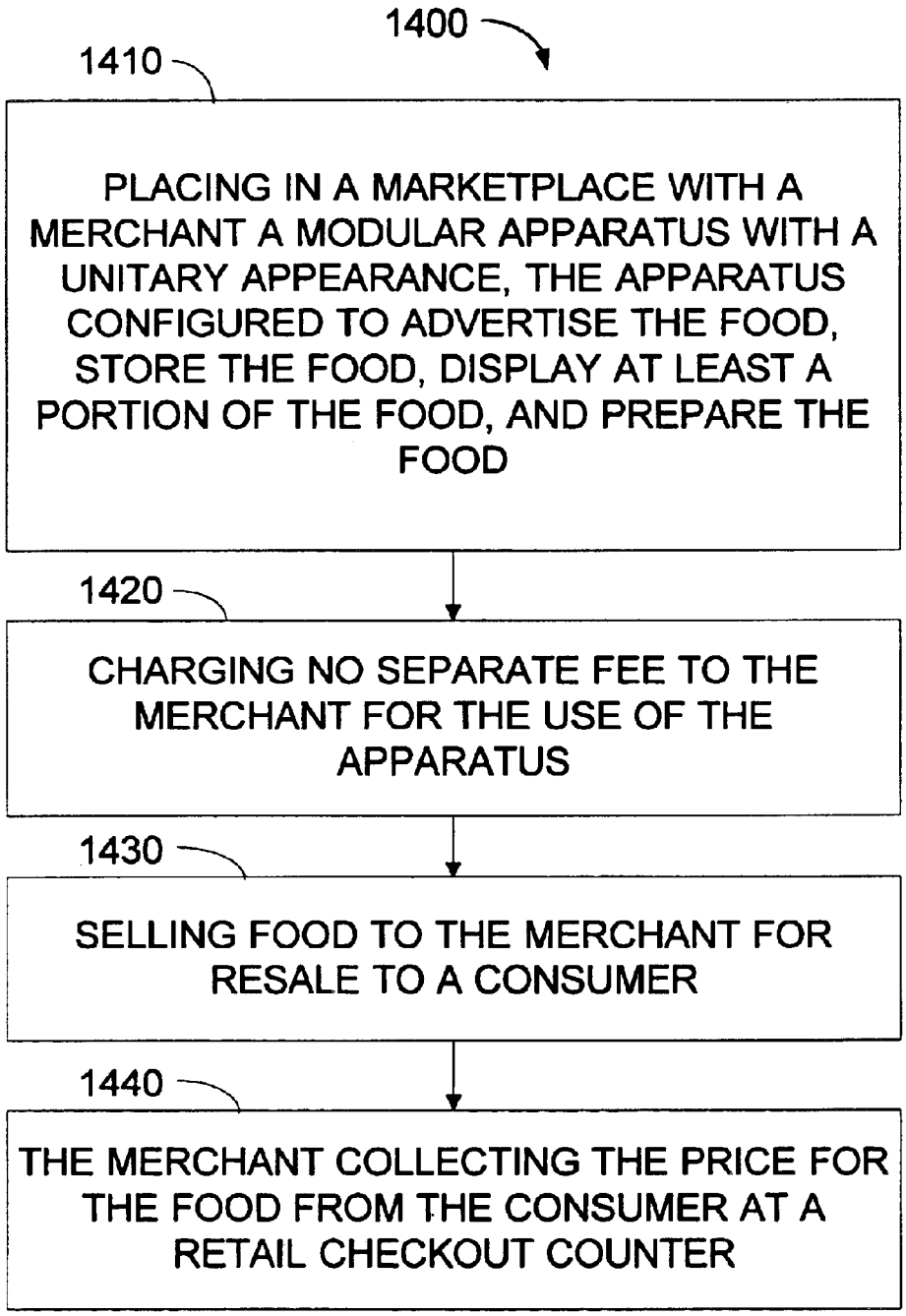
FIG. 12 is a flow diagram of a method of marketing frozen food through a merchant.

FIG. 12 illustrates an embodiment of a method 1400 for merchandising consumer-prepared food comprising a novel combination of steps. In step 1410, a consumer-engaging food merchandising module is placed in a market having a merchant present, such as a convenience store. Placement 1410 involves making an agreement with the merchant, shipping the consumer-engaging food merchandising module to the merchant, and the merchant unpacking, placing in a retail space, and plugging in the consumer-engaging food merchandising module. Step 1420 involves including in the agreement with the merchant a provision under which the merchant is not charged a fee for the use of the consumer-engaging food merchandising module, and profits for the distributor and the merchant are derived from the sale 1430 of the food. The merchant then buys unprepared food, such as frozen french-bread pizza, from the distributor (step 1430) who provided the customer-engaging food merchandising module 100, providing profit to the distributor. The merchant stores and displays the frozen french-bread pizza in the customer-engaging food merchandising module 100, and sells (step 1440) the frozen french-bread pizza to retail customers who select and prepare the food, providing profit to the merchant.

Figure 13:
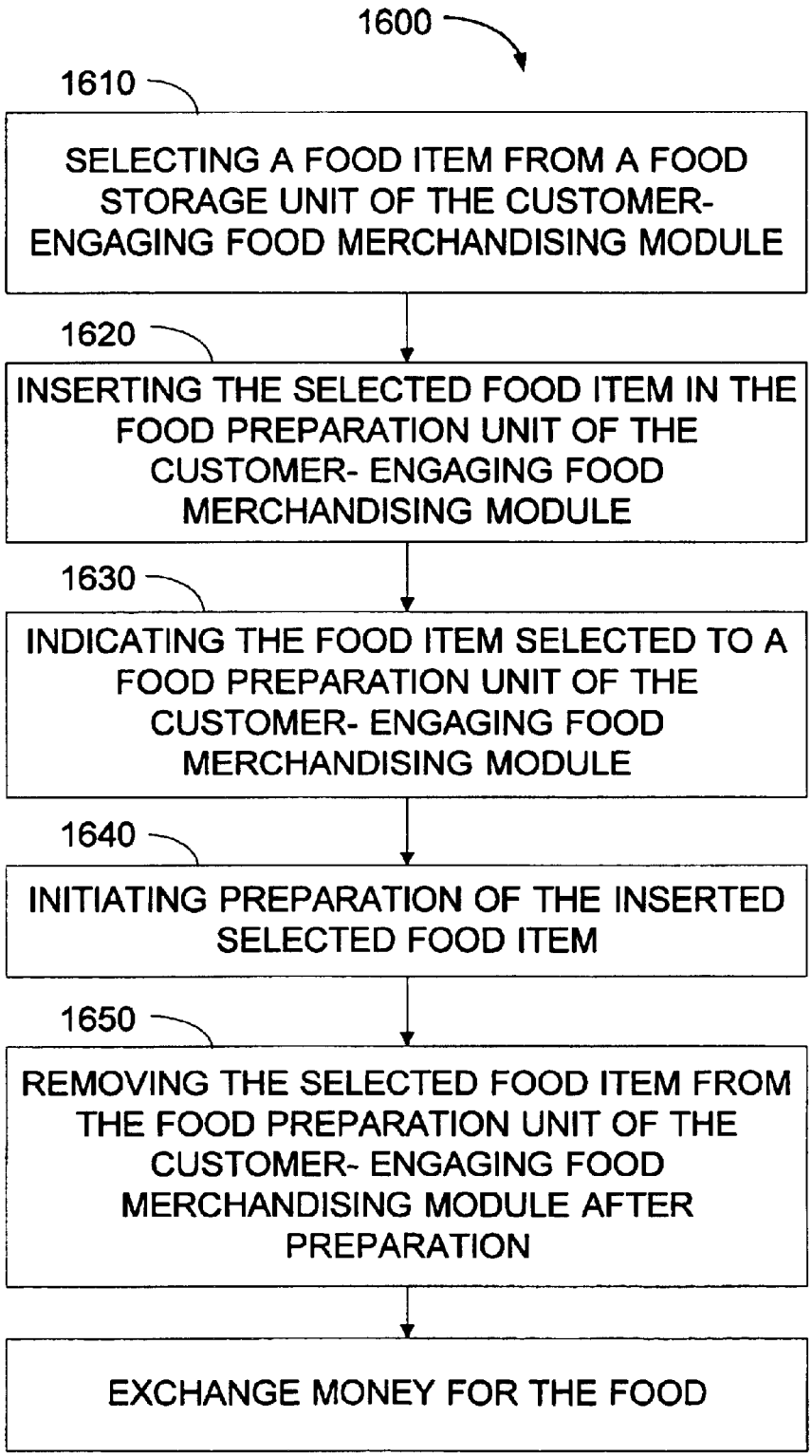
FIG. 13 is a flow diagram of a method of using embodiments of the customer-engaging food merchandising module of the present invention.

FIG. 13 (See also FIG. 1) shows an embodiment of the method 1600 of use of the customer-engaging food merchandising module. After the consumer identifies the customer-engaging food merchandising module 100 from integral advertising and is informed of the operation by signs on the module 100, the customer selects 1610 a food item from the storage unit 102 and inserts 1630 the food item to the attached preparation unit 104. Next, the customer indicates 1620 to the food preparation unit 104 the type of food to be prepared. As explained previously herein, this indication may be manual, audible, or even optical depending upon which type of indication the module is configured to accept. In particular embodiments, the order of performing steps 1620 and 1630 may be reversed. The customer may then initiate 1640 the preparation of the inserted food item. In many embodiments, indication of food type 1620 and initiating 1640 preparation are combined in pressing a single button (202 in FIG. 2). After preparation is complete, the customer removes 1650 the prepared food.

The following is an example of how a particular embodiment of the method and apparatus may be used for marketing, storage, preparation and sale of one or more frozen food products. A customer-engaging food merchandizing module is assembled and shipped to a retail food merchandizer, and is placed in a retail space. A retail space is a place where retail customers have access to the customer-engaging food merchandising module. A retail space may be a convenience store or a booth at a county fair or at a ball game. While the module is in place at the retail space, a customer sees the advertising, or smells food being prepared in the heating unit, and is attracted to the customer-engaging food merchandising module. There, the customer views stored frozen french-bread pizza through a window in the door of a freezer and views advertising on the module to determine what types of frozen foods are available. The customer decides on a type of food to purchase, opens the door of the freezer, and removes the desired food. The customer then opens the door of the microwave oven, places the selected food in the microwave oven, closes the door, and presses a button on a control panel of the microwave oven corresponding to the food item selected. The microwave oven heats the food item according to a pre-programmed heating sequence which may merely be a time sequence, but may also include adjustments to power level for a portion of the heating time. The pre-programmed heating cycle has been pre-determined to be the appropriate heating cycle for the type of food from the freezer corresponding to the button which was pushed and accounts for the temperature at which the food is stored as well as the power of the microwave. At the end of the heating cycle, the customer opens the door, removes the heated food, and pays for the food.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims. Variation in the types of food stored in a particular storage unit is contemplated. For example, frozen french-bread pizza and frozen corn dogs may be stored together. Likewise, different foods, such as hot dogs, corn dogs, pies, burritos, desert cakes and pies, pizzas, and chili, may have dedicated customer-engaging food merchandising modules. A wide variety of configurations and shapes for the shell is also contemplated. Furthermore, the methods and apparatus embodied in the examples provided herein are applicable to a wide range of foods requiring both storage and preparation by a consumer. In addition to frozen foods to be heated, many other foods may be marketed by this method. For example, frozen ice cream cones in a freezer with an attached, heated, chocolate hard-shell-topping dipping pot for consumer-preparation of chocolate dipped cones. For further example, a refrigerator filled with hot dogs attached to a bun steamer for the bun and a microwave oven for the hot dog.

What is claimed is:

1. An apparatus comprising:

a food storage unit sized to contain a plurality of food items;

a food preparation unit removably attached to the food storage unit; and a modular shell removably attached to at least one of the food storage unit and the food preparation unit, the modular shell removably extending around at least one of the food storage unit and the food preparation unit and enclosing at least a majority of at least one side of the food storage unit or the food preparation unit so that the food storage unit and the food preparation unit appear to be substantially coextensive with each other and appear to form a integral unit.

2. The apparatus of claim 1, wherein the food storage unit and the food preparation units are vertically stacked.

3. The apparatus of claim 1, wherein:

the food preparation module has a plurality of buttons corresponding to a plurality of food items to be prepared therein;

the plurality of buttons have a respective plurality of indicia correlated to the plurality of food items; and activation of a particular one of the buttons operates the food preparation unit in a preprogrammed manner to properly prepare a particular food item correlated with the indicia on the particular button.

4. The apparatus of claim 1, wherein:

the food preparation unit is a first food preparation unit of a plurality of food preparation units in the apparatus; and the modular shell incorporates the plurality of food preparation units and the food storage unit into an integral unit.

5. The apparatus of claim 4, wherein the plurality of food preparation units comprise diverse food preparation units for preparing different ones of the food items or for preparing the food items in different ways.

6. The apparatus of claim 4, wherein the plurality of food preparation units comprise similar food preparation units for preparing more than one of the food items at a time.

7. The apparatus of claim 1, wherein the modular shell has a mechanism that directs an appetizing aroma of at least one of the food items from the food preparation unit out of the apparatus so that the appetizing aroma is adapted to engage consumers.

8. An apparatus for use in a retail space in a marketplace, the apparatus comprising:

a freezer sized to contain a plurality of packaged food items;

a microwave oven removably attached to the freezer; and a modular shell comprising foam board removably attached to at least one of the freezer and the microwave oven, the shell removably extending around at least a portion of the microwave oven, enclosing at least a majority of the sides of the microwave oven.

9. The apparatus of claim 8, further comprising a power distribution system having a power receptacle mounted on the freezer, a first power cord extending from the microwave oven to the power receptacle, and a second power cord extending from the power receptacle.

10. The apparatus of claim 8, wherein the microwave oven comprises at least one button pre-programmed to activate the microwave oven to heat a corresponding frozen food item from the freezer for a predetermined appropriate time for that frozen food item.

11. The apparatus of claim 10, wherein the microwave oven comprises at least two buttons, each button corresponding to a different frozen food item from the freezer, each button being pre-programmed to activate the microwave oven to heat the corresponding food item from the freezer for a predetermined time different from the other pre-programmed button.

12. The apparatus of claim 11, wherein each of the at least two buttons indicates its correspondence to the corresponding frozen food by at least one of name, number, color, shape, texture, and pattern.

13. The apparatus of claim 8, wherein the microwave oven comprises an electronic menu of at least one type of frozen food item, wherein selection of the frozen food item from the menu activates the oven to heat the frozen food item selected.

14. The apparatus of claim 8, wherein the microwave oven is attached to the freezer through one of a hook and loop attachment and a rail attachment.

15. The apparatus of claim 8, wherein the shell comprises a lower edge, the lower edge adapted to be received into a resilient bar clamp attached to at least one of the freezer and the microwave oven.

16. The apparatus of claim 1, further comprising a mechanism for accepting input as to a food item to be prepared by the food preparation unit from the food storage unit, wherein the mechanism is configured to accept at least one of a manual input, an audible input, and an optical input.

17. An apparatus for use in a retail space in a marketplace, the apparatus comprising:

a freezer sized to contain a plurality of packaged food items;

a microwave oven removably attached to the freezer; and a modular shell removably attached to at least one of the freezer and the microwave oven, the shell removably extending around at least a portion of the microwave oven, enclosing at least a majority of the sides of the microwave oven;

wherein the microwave oven comprises at least one button pre-programmed to activate the microwave oven to heat a corresponding frozen food item from the freezer for a predetermined appropriate time for that frozen food item.

18. The apparatus of claim 17, wherein the microwave oven comprises at least two buttons, each button corresponding to a different frozen food item from the freezer, each button being pre-programmed to activate the microwave oven to heat the corresponding food item from the freezer for a predetermined time different from the other pre-programmed button.

19. The apparatus of claim 15, wherein each of the at least two buttons indicates its correspondence to the corresponding frozen food by at least one of name, number, color, shape, texture, and pattern.

20. The apparatus of claim 17, further comprising a power distribution system having a power receptacle mounted on the freezer, a first power cord extending from the microwave oven to the power receptacle, and a second power cord extending from the power receptacle.

21. The apparatus of claim 17, wherein the microwave oven comprises an electronic menu of at least one type of frozen food item, wherein selection of the frozen food item from the menu activates the oven to heat the frozen food item selected.

22. The apparatus of claim 17, wherein the microwave oven is attached to the freezer through one of a hook and loop attachment and a rail attachment.

23. The apparatus of claim 17, wherein the shell comprises a lower edge, the lower edge adapted to be received into a resilient bar clamp attached to at least one of the freezer and the microwave oven.

24. An apparatus for use in a retail space in a marketplace, the apparatus comprising:

a freezer sized to contain a plurality of packaged food items;

a microwave oven removably attached to the freezer;

a modular shell removably attached to at least one of the freezer and the microwave oven, the shell removably extending around at least a portion of the microwave oven, enclosing at least a majority of the sides of the microwave oven; and a power distribution system having a power receptacle mounted on the freezer, a first power cord extending from the microwave oven to the power receptacle, and a second power cord extending from the power receptacle and configured to plug into a separate power receptacle.

25. The apparatus of claim 24, wherein the microwave oven comprises at least two buttons, each button corresponding to a different frozen food item from the freezer, each button being pre-programmed to activate the microwave oven to heat a corresponding food item from the freezer for a predetermined time different from the other pre-programmed button.

26. The apparatus of claim 25, wherein each of the at least two buttons indicates its correspondence to the corresponding frozen food by at least one of name, number, color, shape, texture, and pattern.

27. The apparatus of claim 24, wherein the microwave oven comprises an electronic menu of at least one type of frozen food item, wherein selection of the frozen food item from the menu activates the oven to heat the frozen food item selected.

28. The apparatus of claim 24, wherein the microwave oven is attached to the freezer through one of a hook and loop attachment and a rail attachment.

29. The apparatus of claim 24, wherein the shell comprises a lower edge, the lower edge adapted to be received into a resilient bar clamp attached to at least one of the freezer and the microwave oven.

30. An food storage, preparation and display unit comprising:

a food storage unit sized to contain a plurality of food items;

a food preparation unit positioned above the food storage unit and supported by the food storage unit; and a removable shell supported by the food storage unit and removable from it, the removable shell enclosing a majority of at least one of a side and a top of the food preparation unit;

wherein the food storage unit, the food preparation unit and the shell are each removable from each other.

31. The apparatus of claim 30, wherein the food preparation unit is in direct contact with the food storage unit.

32. The unit of claim 30, wherein:

the food preparation module has a plurality of buttons corresponding to a plurality of food items to be prepared therein;

the plurality of buttons have a respective plurality of indicia correlated to the plurality of food items; and activation of a particular one of the buttons operates the food preparation unit in a preprogrammed manner to properly prepare a particular food item correlated with the indicia on the particular button.

33. The unit of claim 30, wherein the food storage unit comprises a see-through door that opens from a front side of the food storage unit.

34. The unit of claim 30, wherein the removable shell is configured to enclose a majority of the top and at least one side of the food preparation unit.

* * * * *